United States Patent [19]

Sawada et al.

[11] 4,007,746

[45] Feb. 15, 1977

[54] METHOD FOR PREPARING CELLULOSE ACETATE FIBER RODS

[75] Inventors: Hideo Sawada, Osaka; Motoharu Kotani, Sakai, both of Japan

[73] Assignee: Daicel, Ltd., Osaka, Japan

[22] Filed: June 2, 1975

[21] Appl. No.: 582,635

[30] Foreign Application Priority Data

June 21, 1974 Japan ..... 49-71062

[52] U.S. Cl. ..... 131/267; 106/180

[51] Int. Cl.[2] ..... A24C 5/50

[58] Field of Search ..... 131/266–268; 106/180; 156/166, 180, 307

[56] References Cited

UNITED STATES PATENTS

| | | | |
|---|---|---|---|
| 2,017,070 | 10/1935 | Lazier et al. | 106/180 |
| 3,882,878 | 5/1975 | Sawada et al. | 131/267 |

OTHER PUBLICATIONS

Def. Pub., published 11/4/1975, T940,006; Plasticized Blends for Tobacco Smoke Filter Rods and Filter Rods Bonded by such Blends; Morie et al.

*Primary Examiner*—Robert W. Michell
*Assistant Examiner*—V. Millin
*Attorney, Agent, or Firm*—Woodhams, Blanchard and Flynn

[57] ABSTRACT

A method for preparing a cellulose acetate fiber rod is provided, which is characterized by blooming a tow composed of cellulose acetate fibers, adding to or coating on the bloomed tow from 1 to 20 percent by weight (based on the weight of the cellulose acetate fibers) of a plasticizer comprising 1,4-butanediol diacetate, and gathering and curing the resulting cellulose acetate fibers at much higher speed than is possible in the conventional methods to form a cigarette filter rod which does not harm cigarette flavor and smoking taste.

9 Claims, No Drawings

METHOD FOR PREPARING CELLULOSE ACETATE FIBER RODS

BACKGROUND OF THE INVENTION

1. Field of the Invention

This invention relates to a method for preparing a cellulose acetate filter rod useful as a cigarette filter. More particularly, this invention relates to a method for preparing a cellulose acetate filter rod which comprises adding a plasticizer containing 1,4-butanediol diacetate to cellulose acetate fibers.

2. Description of the Prior Art

Plasticizers for cellulose acetate rods, which are useful as tobacco smoke filters, are essential because such plasticizers dissolve or partially dissolve the cellulose acetate fibers at the places where they contact each other and, as a result of curing, the fibers mutually unite at their random points of contact, whereby the united fibers maintain the shape of the resulting rod, give the rod a suitable hardness and impart to the rod itself the hardness required so that the rod can be cut into tobacco smoke filters, such as cigarette filters.

In general, triacetin, the diacetate, dipropionate, and dibutyrate esters of triethyleneglycol, dimethoxyethyl phthalate, and triethyl citrate are used as plasticizers for cellulose acetate fibers constituting cigarette filters. However, when triethyl citrate and dimethoxyethyl phthalate are used, it is necessary to heat the fiber rods at a high temperature above room temperature for 2 to 4 hours in the step of curing the rods.

The diacetate, dipropionate and dibutyrate esters of triethyleneglycol can confer sufficient hardness on the rods, when cured at room temperature for a relatively short time, but the resulting filters are not satisfactory with respect to the cigarette flavor and smoking taste.

We have previously discovered that 1,3-butanediol diacetate is a plasticizer which is excellent in plasticizing effect on cellulose acetate fibers and which does not harm the cigarette flavor and smoking taste, as described in our Japanese Patent application No. 1974–36,899 (unexamined). However, that compound is defective because it has a low boiling point and a peculiar odor and, therefore, it is difficult to employ in practice.

Also, the plugmaking machine itself has been greatly improved so that its tape speed has become remarkably high. Thus, the tape speed of a Hauni KDF-2 plugmaker is 400 m/min., and this is approximately twice as high as that in conventional machines and it is likely that this speed will further increase.

In view of these circumstances, the long curing time required with conventional plasticizers to achieve the necessary rod hardness causes serious problems in practical use.

SUMMARY OF THE INVENTION

We have discovered that by applying to a bloomed cellulose acetate fiber tow, a plasticizer consisting of 1,4-butanediol diacetate or a mixture of 1,4-butanediol diacetate and one or more plasticizers for cellulose acetate fibers, the tow can be cured at a remarkably higher speed than in the conventional methods and there is obtained a cellulose acetate rod which does not harm cigarette flavor and smoking taste.

DETAILED DESCRIPTION OF THE INVENTION

We discovered that when a plasticizer containing, as at least one ingredient, 1,4-butanediol diacetate is used, a cellulose acetate fiber rod can be cured at room temperature (18°–25° C) at a speed higher than that which is possible when triacetin is used. Triacetin has previously been considered to cure such rods at the highest speed. In addition, we found that 1,4-butanediol diacetate has a boiling point of 230° C which is higher than that of 1,3-butanediol diacetate and also that it is an odorless and non-toxic plasticizer which does not harm the cigarette taste and smoking flavor.

Thus, this invention relates to a method for preparing a cellulose acetate fiber rod, such as a cigarette smoking filter, which employs a special plasticizer for curing the resulting rod at a high speed.

1,4-Butanediol diacetate used as a plasticizer in this invention is a compound having the formula:

$$CH_3—COO—CH_2—CH_2—CH_2—CH_2—OCOCH_3.$$

It can be used alone or in combination with other plasticizers. For example, it can be used together with triacetin, triethyleneglycol diacetate, and other plasticizers. The amount of 1,4-butanediol diacetate is at least 20 percent by weight, based on the total weight of plasticizers applied to the cellulose acetate fibers.

1,4-Butanediol diacetate is so excellent in its plasticizing effect that it can exert a sufficient effect when it is employed in much smaller amounts than the conventionally used amounts of triacetin or triethyleneglycol diacetate.

In this invention, the plasticizer is added in an amount of from 1 to 20 percent by weight (all percentage values given hereinafter are on a weight basis), especially 3 to 10 percent, based on the weight of the cellulose acetate fibers.

In this invention, the cellulose acetate fibers are used in the form of a tow obtained by gathering 3,000 to 100,000 continuous fibers each having a filament denier of 1 to 6 denier. It is preferred that 10 to 30 uniform crimps are given to the tow, per 25 mm of length of the tow.

Any method for applying the plasticizer uniformly or nearly uniformly to the cellulose acetate fiber tow can be employed in this invention, without limitation. For instance, the plasticizer can be applied to both the upper and lower surfaces of the tow by a known method using a spray gun or a wick. When the plasticizer is non-uniformly applied to the tow, at the portions of the two where the plasticizer is locally present in excess, the cellulose acetate fibers are dissolved to form a dope in the tow, whereas at the portions where an insufficient amount is present, a sufficient bonding is not obtained between the fibers. Therefore, it is important in this invention that the plasticizer is distributed uniformly or nearly uniformly in the interior of the tow band.

In this invention, the preparation of cigarette filters from plasticizer-incorporated tows can be conducted by methods now industrially performed for the preparation of cigarette filters made of cellulose acetate fibers.

The method according to this invention, as mentioned above, can produce cellulose acetate fiber tows suitable for cigarette filters and the fiber rod can be cured at extremely high speed without damaging the characteristics of the cellulose acetate fibers.

Further, the cellulose acetate rod obtained bv the method of this invention can be also used as ink-holding substances such as felt tip marking pens, and other widely used products. Hence it is of great industrial value.

The method of this invention will be further described by reference to illustrative Examples wherein the production of cigarette filters will be shown. Of course, this invention is not limited to these Examples. In the Examples, the rod hardness and the pressure drop were determined by the following methods. (Hardness)

A load of 300 g was imposed on a sample rod by means of a disc of 12 mm in diameter for 10 seconds. The depth of the dent formed by the load was read and the depth is expressed as hardness units wherein each hardness unit equals 0.1 mm. A lower value indicates that the sample is hard and a higher value indicates that the sample is soft. (Pressure Drop)

Pressure drop is expressed in terms of the resistance pressure, expressed as water column height (mm), obtained when air was passed through a filter rod of a length of 102 mm at a rate of 17.5 ml/sec.

EXAMPLES 1–5

A cellulose acetate fiber tow having a filament denier of 4 and a total denier of 43,000, and having 26 crimps per 25 m of length, was bloomed and 1,4-butanediol diacetate or a mixture of 1,4-butanediol diacetate and another plasticizer in an equal amount by weight was applied in a predetermined amount to the bloomed cellulose acetate fiber tow by means of a plasticizer applicator. Then, the tow was fed to a paper wrapping apparatus, was wrapped by a rice paper and was cut to a length of 102 mm.

Such filter characteristics as the rod weight (g/rod), the pressure drop (mm $H_2O$), and the hardness of the rod after the rod was allowed to stand for one hour and 24 hours at 20° C after making the rod were determined with respect to the resulting rod. The results are shown in Table 1.

For the purpose of comparison, the foregoing procedure was repeated in the same manner by using triacetin, triethyleneglycol diacetate, and triethyleneglycol dipropionate, as well as no plasticizer. The properties of the resulting filter rods were determined in the same way. The results are shown in Table 1.

Table 1 shows that the time required for obtaining sufficient hardness (less than about 9 hardness units) is 24 hours when either triacetin or triethyleneglycol diacetate is employed, whereas it takes only one hour when there is used 1,4-butanediol diacetate or a mixture of 1,4-butanediol diacetate and triacetin in equal amounts. Further, it shows that particularly 1,4-butanediol diacetate, when used even in only a small amount, can give a sufficient satisfactory effect.

Each of the resulting rods having a length of 102 mm was divided into six filter tips having a length of 17 mm. A filter tip of a commercially available Hilite cigarette (trademark) was removed and the thus obtained tip was attached in its place. As a result of the smoking test, it was found that good taste and flavor were obtained in the case of the plasticizers comprising 1,4-butanediol diacetate as an ingredient.

Table 1

RELATION BETWEEN PLASTICIZERS USED AND PROPERTIES OF THE RESULTING ROD

| Example No. | Plasticizer: Type | Plasticizer: Used amount (% by weight) | Rod weight (g/rod) | Pressure drop (mm $H_2O$) | Hardness: After one hour | Hardness: After 24 hours |
|---|---|---|---|---|---|---|
| Example 1 | 1,4-butanediol diacetate | 5.0 | 0.725 | 245 | 8.7 | 7.9 |
| Example 2 | 1,4-butanediol diacetate | 7.0 | 0.736 | 261 | 8.1 | 7.3 |
| Example 3 | 1,4-butanediol diacetate | 9.0 | 0.747 | 263 | 8.3 | 6.5 |
| Example 4 | Mixture of 1,4-butanediol diacetate and triacetin in an equal amount by weight | 7.0 | 0.730 | 260 | 8.7 | 8.0 |
| Example 5 | Mixture of 1,4-butanediol diacetate and triethyleneglycol diacetate in an equal amount by weight | 9.0 | 0.734 | 265 | 8.4 | 7.8 |
| Comparative Example 1 | In the absence of plasticizer | 0 | 0.677 | 247 | 12.1 | 12.7 |
| Comparative Example 2 | Triacetin | 8.0 | 0.735 | 259 | 10.5 | 8.3 |
| Comparative Example 3 | Triethyleneglycol diacetate | 6.3 | 0.743 | 253 | 10 | 9.8 |
| Comparative Example 4 | Triethylene glycol dipropionate | 9.0 | 0.738 | 258 | 10 | 8.5 |

The embodiments of this invention in which an exclusive property or privilege is claimed are defined as follows:

1. In a method for preparing a cellulose acetate fiber rod, which comprises blooming a tow composed of cellulose acetate fibers, applying a plasticizer substantially uniformly to the bloomed tow, and gathering and curing the resulting bloomed tow to form a filter rod, the improvement which comprises: there is applied as a plasticizer from 1 to 20 percent by weight, based on the weight of the cellulose acetate fibers, of a plasticizer comprising 1,4-butanediol diacetate.

2. The method of claim 1 wherein the plasticizer-containing bloomed tow is cured at about 20° C for about 1 hour.

3. The method of claim 1 wherein said plasticizer consists essentially of 1,4-butanediol diacetate.

4. The method of claim 1 wherein said plasticizer consists essentially of 1,4-butanediol diacetate and up to 80 percent by weight of at least one additional plasticizer selected from the group consisting of triacetin, the diacetate, dipropionate and dibutyrate esters of triethylene glycol, dimethoxyethyl phthalate and triethyl citrate.

5. The method of claim 1 in which the amount of plasticizer is from 5 to 10 percent by weight, based on the weight of cellulose acetate fibers.

6. A tobacco smoke filter comprising a bundle of from 3,000 to 100,000 substantially longitudinally extending cellulose acetate fibers each having a filament denier of 1 to 16, said fibers being substantially uniformly coated with from 1 to 20 percent by weight, based on the weight of said fibers, of a plasticizer comprising 1,4-butanediol diacetate.

7. A tobacco smoke filter according to claim 6, in which the amount of the plasticizer is from 5 to 10 percent by weight, based on the weight of said cellulose acetate fibers.

8. A tobacco smoke filter according to claim 6, wherein said plasticizer consists essentially of 1,4-butanediol diacetate.

9. A tobacco smoke filter according to claim 6, wherein said plasticizer consists essentially of 1,4-butanediol diacetate and up to 80 percent by weight of at least one additional plasticizer selected from the group consisting of triacetin, the diacetate, dipropionate and dibutyrate esters of triethylene glycol, dimethoxyethyl phthalate and triethyl citrate.

* * * * *